US010125479B2

(12) United States Patent
Gogoulis

(10) Patent No.: US 10,125,479 B2
(45) Date of Patent: Nov. 13, 2018

(54) P-TRAP PLUMBING CONNECTION AND A METHOD OF INSTALLING A P-TRAP PLUMBING CONNECTION

(71) Applicant: George N. Gogoulis, Victoria (CA)

(72) Inventor: George N. Gogoulis, Victoria (CA)

( * ) Notice: Subject to any disclaimer, the term of this patent is extended or adjusted under 35 U.S.C. 154(b) by 0 days.

(21) Appl. No.: 15/479,849

(22) Filed: Apr. 5, 2017

(65) Prior Publication Data

US 2017/0292254 A1 Oct. 12, 2017

(30) Foreign Application Priority Data

Apr. 7, 2016 (CA) ..... 2926441

(51) Int. Cl.
*E03C 1/28* (2006.01)
*E03C 1/284* (2006.01)
*E03C 1/32* (2006.01)

(52) U.S. Cl.
CPC ..... *E03C 1/284* (2013.01); *E03C 2001/321* (2013.01)

(58) Field of Classification Search
CPC ..... E03C 1/284
USPC ..... 4/679–694
See application file for complete search history.

(56) References Cited

U.S. PATENT DOCUMENTS 2,015,469 A 9/1935 Church
3,487,478 A * 1/1970 Harris ..... A47K 1/08 312/210
4,597,404 A * 7/1986 Van Marcke ..... E03C 1/28 137/1
4,646,370 A * 3/1987 Risberg ..... E03C 1/32 4/420
5,711,037 A * 1/1998 Reichardt ..... E03C 1/281 4/144.1
6,004,470 A * 12/1999 Abril ..... B01D 17/00 210/776
6,053,197 A * 4/2000 Gorges ..... E03C 1/281 137/247.39
6,425,411 B1 * 7/2002 Gorges ..... E03C 1/28 137/247.39
6,845,527 B1 * 1/2005 Kohn ..... E03C 1/12 137/247.41
6,959,723 B2 * 11/2005 Gorges ..... E03C 1/28 137/247.39
7,636,957 B2 * 12/2009 Funari ..... E03C 1/281 4/144.1
8,033,486 B2 * 10/2011 Berger ..... E03C 1/122 137/247.27
2003/0163869 A1 * 9/2003 Bosch ..... E03C 1/284 4/679

* cited by examiner

*Primary Examiner* — Lori Baker
(74) *Attorney, Agent, or Firm* — Davis & Bujold PLLC; Michael J. Bujold

(57) ABSTRACT

A P-trap plumbing connection is positioned within a housing and a method of installation involves mounting the housing either on a wall or within a wall. When this method is used the space below a sink or inside a cabinet is no longer occupied to the same degree by the p-trap and drain piping.

6 Claims, 8 Drawing Sheets

P-TRAP PLUMBING CONNECTION AND A METHOD OF INSTALLING A P-TRAP PLUMBING CONNECTION

FIELD

The present invention relates to P-traps used with plumbing fixtures, such as sinks.

BACKGROUND

The current common method for connecting plumbing to a fixture (a sink for example), is to locate the p-trap and associated drain piping directly below the drain port of the fixture (sink). When the sink is positioned over a cabinet, the p-trap and drain piping occupy substantial space inside of the cabinet. When the sink is wall mounted, the p-trap is exposed to view and limits handicapped accessibility of the sink.

SUMMARY

According to one aspect the present invention provides a method for installing a p-trap and connecting a plumbing fixture to the building plumbing lines. The method involves housing a P-trap within a housing. The P-trap will have an inlet connection and an outlet connection. The method further involves mounting the housing either on a wall or within a wall. The method finally involves connecting a first pipe to the inlet connection and a second pipe to the outlet connection such that flow from the first pipe passes through the P-trap to the second pipe. When this method is used the space below the sink is no longer occupied to the same degree by the p-trap and drain piping.

According to another aspect the present invention provides a P-trap Plumbing Connection which includes a housing having a front, a back, and opposed sides that define an interior cavity. An access opening to the interior cavity is provided in at least one of the front or the back. A P-trap is positioned within the interior cavity of the housing. The P-trap has an inlet connection at one of the front or the back of the housing and an outlet connection at one of the opposed sides of the housing.

The P-trap plumbing connection described above relocates the p-trap drain pipe against or in the wall. Optionally, hot and cold water supply lines can also be consolidated into a singular, clean, decorative, assembly.

The preferred embodiment, which will hereinafter be further described is an in-wall plumbing connection box that includes the p-trap, along with the hot and cold water supply lines. The in-wall plumbing connection box is comprised of two major components; a reversible housing providing two different drain arrangements with an internal p-trap drain pipe assembly and an adjustable pipe connector. Also forming part of said in-wall plumbing connection box are ancillary components for a flexible plumbing installation including removable front and back panels for a clean and decorative appearance.

The reversible housing is generally rectangular in shape, comprised of four sides, has three compartments therein and has an open front and back. One side of said reversible housing provides mounting flanges for securing the assembly to the buildings wall framing members. The opposing side provides an outlet opening formed therein for connection to the building plumbing lines. The top and bottom of said reversible housing connect the two sides and preferably include reinforcing ribs to provide stiffness and strength.

Said reversible housing can be reversed so that the installation can connect to the building plumbing lines from either side. The back panel is configured to close the back of said reversible housing regardless of the orientation of building plumbing lines. Said reversible housing is divided into three compartments of varying sizes. The larger compartment constitutes approximately two thirds of the lower portion of said reversible housing and is where said internal p-trap piping is located. The upper half of said reversible housing is further divided into two unequal compartments one containing an inlet opening with said adjustable connection to a plumbing fixture (a sink for example), the other containing the water supply line connection points. Said opposing side outlet opening which connects to the building plumbing is located within said lower compartment and is connected to the horizontal outlet arm of said internal p-trap pipe.

Said internal p-trap pipe forms a general 'U' shape down from said outlet arm. At the bottom of the 'U' shaped pipe is a removable treaded clean-out stopper which permits general access into said p-trap for retrieval, cleaning or unblocking purposes. The other leg of the 'U' shaped pipe connects to the upper compartment containing the inlet opening.

Said inlet opening is preferably threaded to receive said adjustable pipe connector. Said inlet opening is initially provided with a removable test cap that would be removed after testing has been completed which would allow said adjustable pipe connector to then be installed. Said adjustable pipe connector allows said in-wall connection box to be located out of alignment with the plumbing fixture (a sink for example).

The third and final compartment in said reversible housing has four supply water openings. Two of the supply water openings are front facing and two are back facing to accommodate the reversible function of said reversible housing. Regardless of the orientation of said reversible housing, two forward facing supply water openings will be present for locating the buildings water supply lines. Each said supply water opening is configured to mate with an ancillary locking escutcheon. Preferably, each said locking escutcheon is keyed to differentiate between the buildings hot and cold water supply lines. Said locking escutcheons would be fitted onto the buildings respective water supply lines and then installed within said openings.

The removable front panel has one large generally rectangular shaped opening at the top that allows for the drain and supply lines to pass and connect to said top compartments. Said front panel covers and conceals said internal p-trap and has flanges that extend beyond the perimeter of said reversible housing to conceal the cut wall and/or cabinet opening. Said front panel is divided into two pieces, a top portion and a bottom portion.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
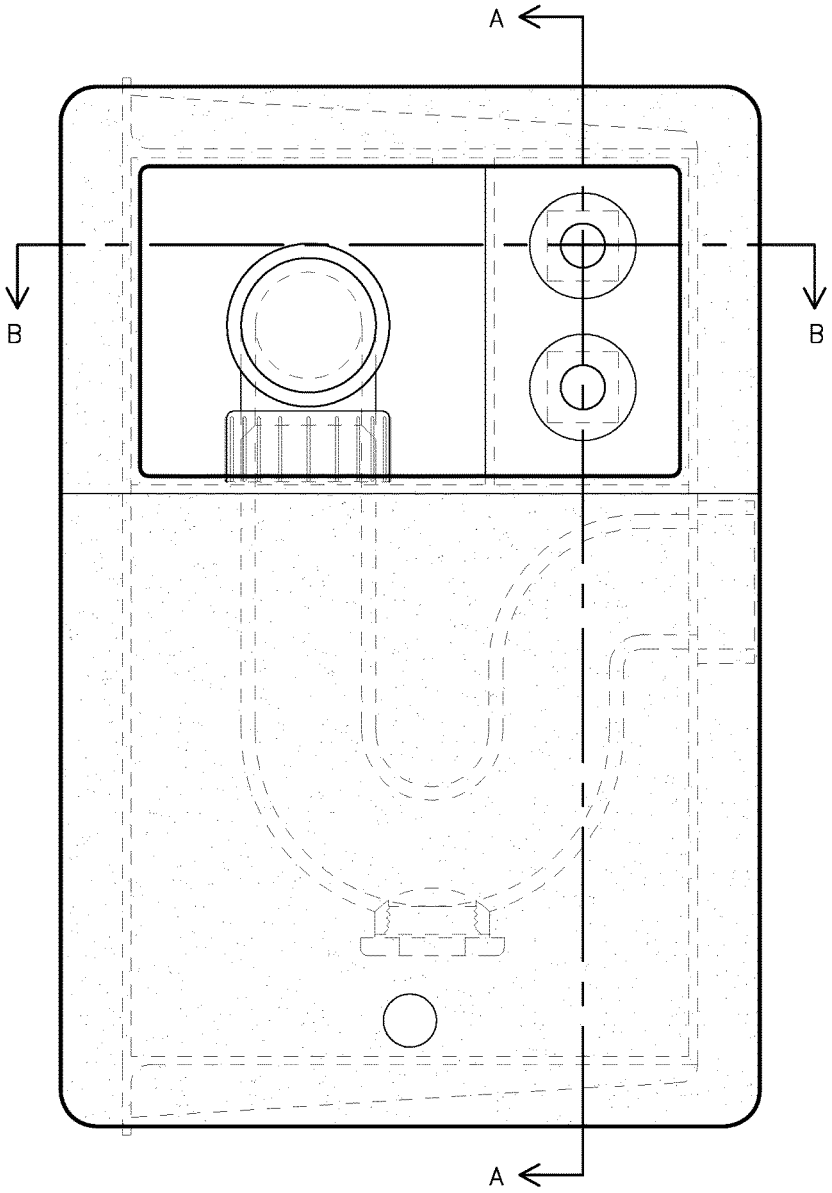
FIG. 1 is a front view of the IN-WALL PLUMBING CONNECTION BOX according to the present invention with the outlet drain located to the right.
Figure 10:
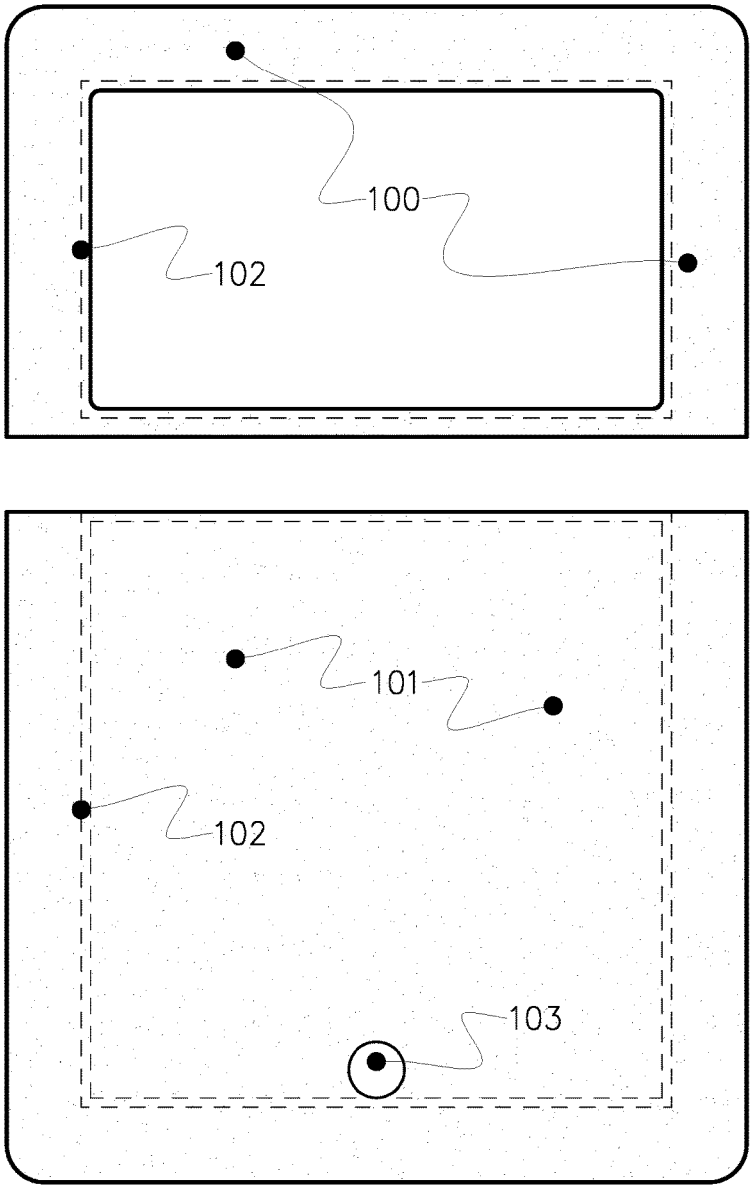
FIG. 10 is a front view of the two piece front panel
Figure 11:
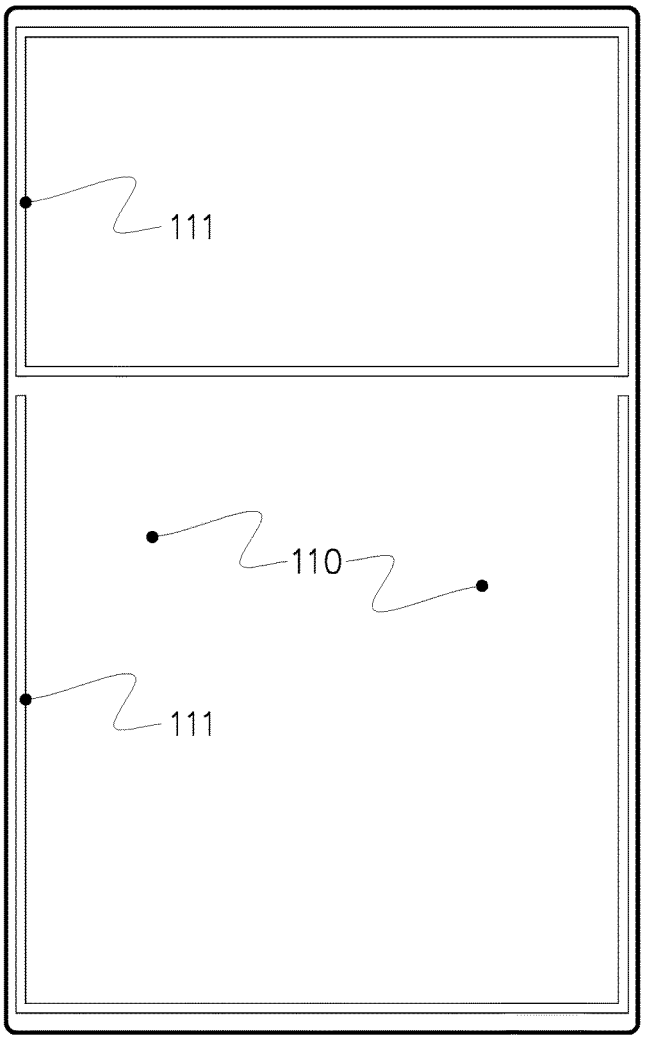
FIG. 11 is a front view of the back panel

The IN-WALL PLUMBING CONNECTION BOX (FIG. 1) is comprised of the reversible housing with an internal p-trap drain pipe assembly (FIG. 5), the ancillary components (FIG. 6, FIG. 7, FIG. 8 and FIG. 9), the removable front panel (FIG. 10) and the back panel (FIG. 11).

Figure 2:
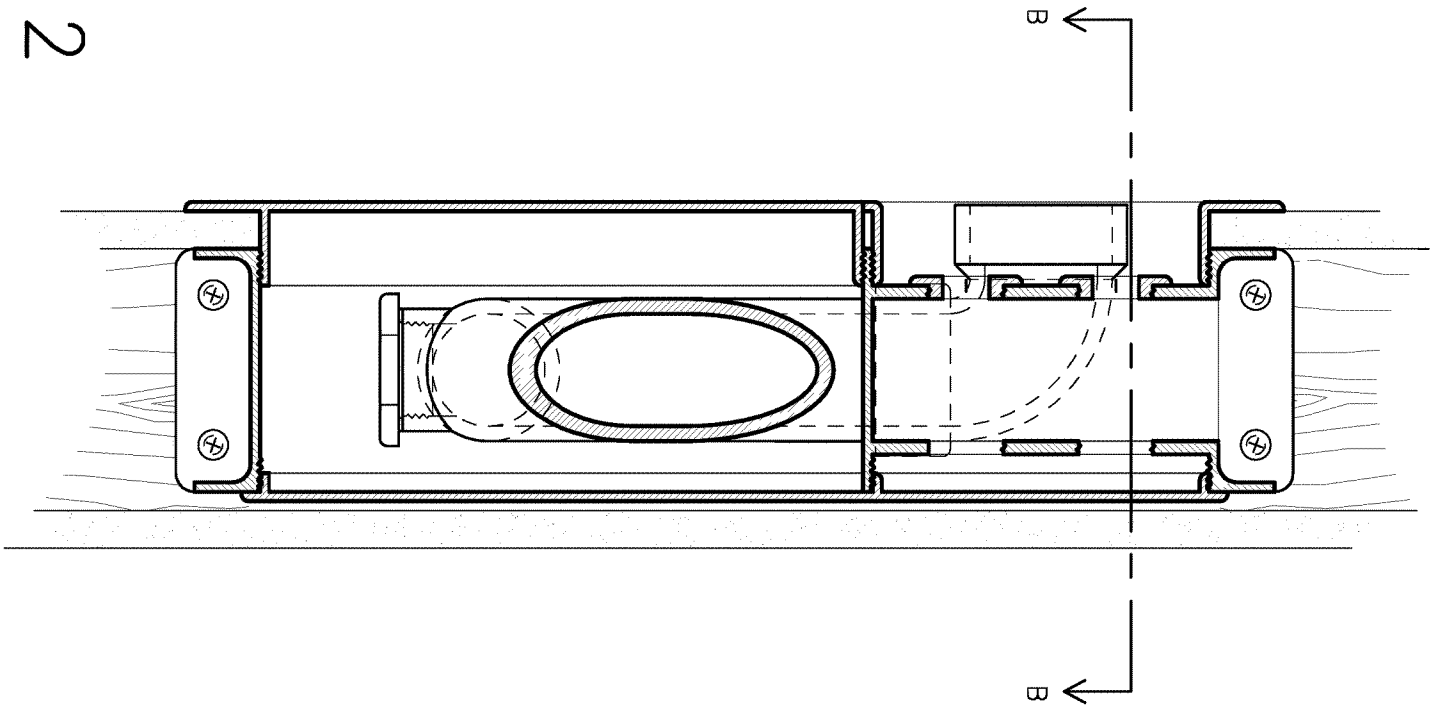
FIG. 2 is a side sectional view taken along section line AA of FIG. 1 of the IN WALL PLUMBING CONNECTION BOX installed within a wall.
Figure 3:
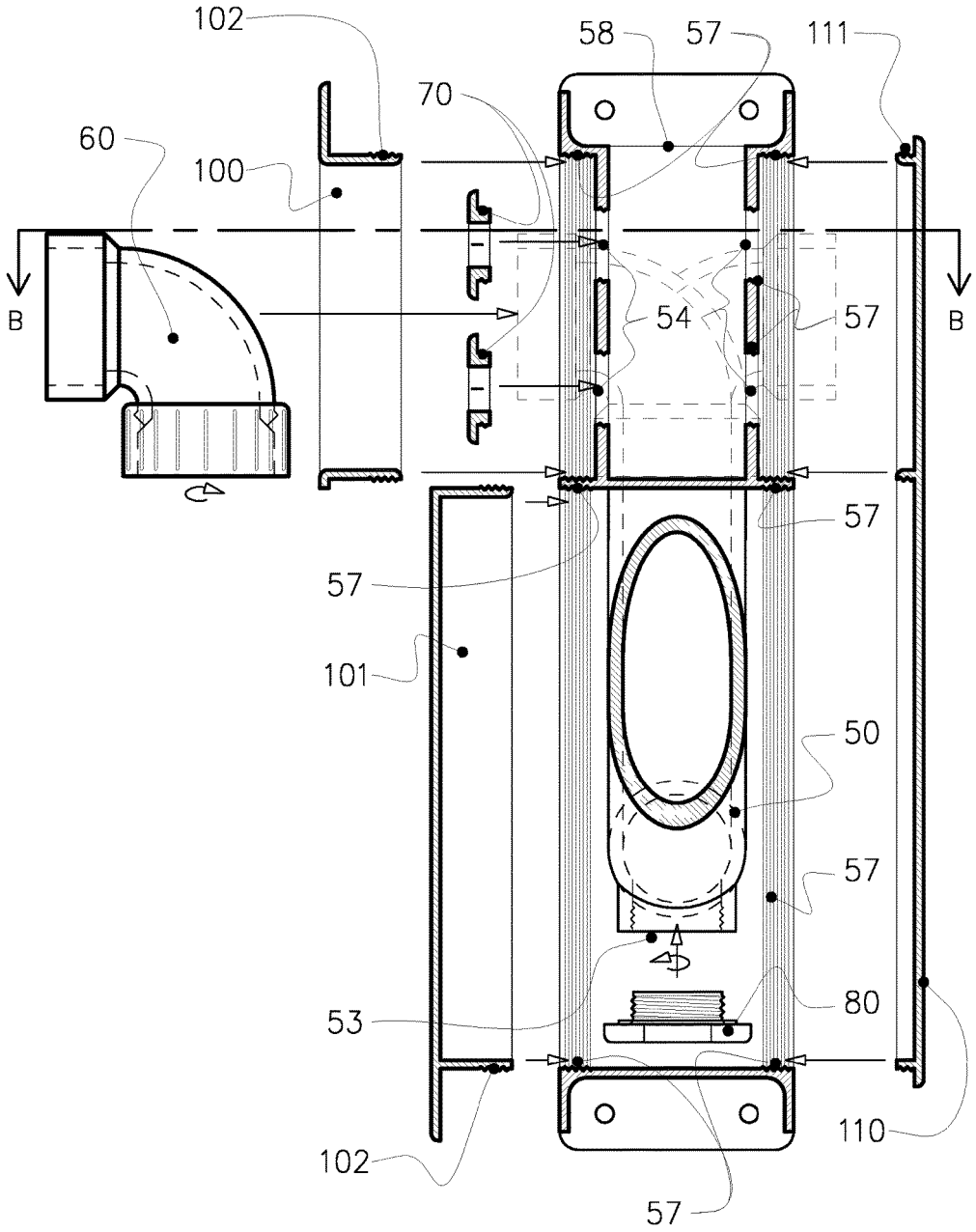
FIG. 3 is an exploded side sectional view of the IN WALL PLUMBING CONNECTION BOX taken along section line AA of FIG. 1
Figure 4:
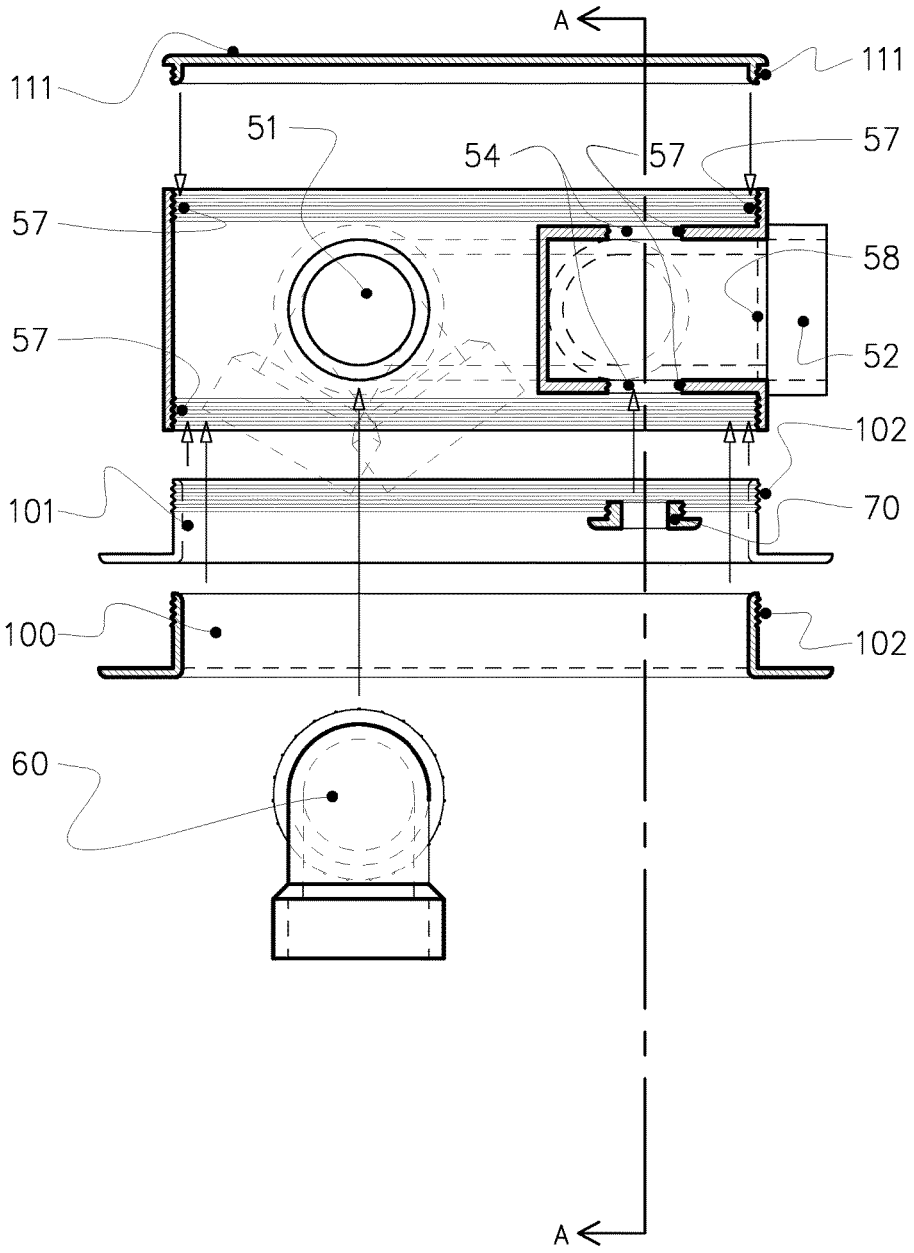
FIG. 4 is an exploded top sectional view of the IN WALL PLUMBING CONNECTION BOX taken along section line BB of FIG. 1 and indicates the articulation of the adjustable pipe connector
Figure 5:
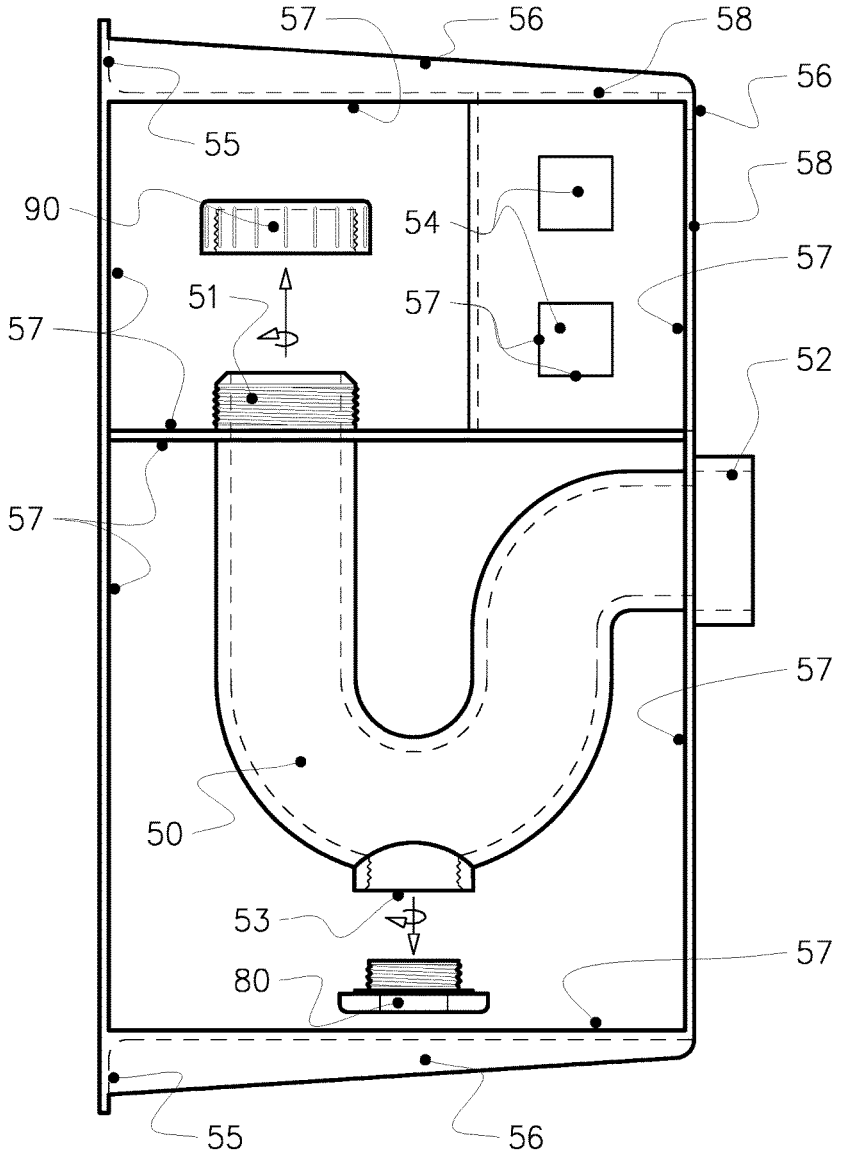
FIG. 5 is front view of the reversible housing and internal p-trap piping with the outlet drain located to the right

Said reversible housing (FIG. 5) has two side walls, a top wall with a rectangular opening (58), a continuous bottom wall and an open front and back. One of the side walls provides mounting flanges (55) that extend past the top and bottom of the side wall. Each flange preferably has two screw holes for securing the assembly to the buildings wall framing members with screws (FIG. 2). The opposite side wall has an upper rectangular opening (58) and provides an outlet opening (52) formed therein. Said outlet opening (52) includes a female circumferential flange that is sized and shaped to provide a solvent welded connection to the building plumbing lines (not shown). The top and bottom of said reversible housing preferably include reinforcing flanges (56) formed therein to provide stiffness and strength to said reversible housing (FIG. 5). The perimeter of the interior walls of said reversible housing (FIG. 5) are molded with a plurality of perimeter ribs (57) to positively engage and fix the front panels (FIG. 10) and back panels (FIG. 11) in place. Said back panel (FIG. 11) is molded with raised tabs with a plurality of ribs (111) that mate with the plurality of perimeter ribs (57) of said reversible housing (FIG. 5) regardless of its orientation.

Figure 8:
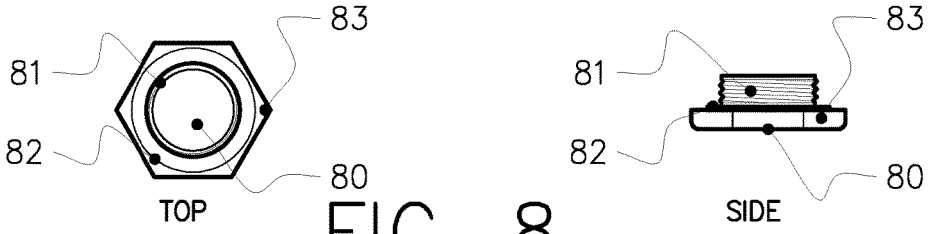
FIG. 8 is a top and side view of the clean-out stopper

The larger lower compartment is where said internal p-trap piping (50) is located. Said internal p-trap (50) could be molded as part of said reversible housing or could be separately fabricated piping integrated within said reversible housing. Said p-trap (50) is connected with and integrally part therein of said outlet opening (52). Said p-trap piping (50) forms a horizontal arm with a slight upward slope then turns to form a general 'U' shape down from said outlet opening (52). At the bottom of the 'U' shape is a clean-out port (53) with a removable clean-out stopper (80) (FIG. 8) in place. Said clean-out port (53) is preferably a female configured opening that is threaded to receive the removable clean-out stopper (80) (FIG. 8).

Said removable clean-out stopper (80) (FIG. 8) is preferably a male configured circumferential flange (81) that is threaded to mate with said clean-out port (53). Said threaded circumferential flange (81) is molded as part of a preferably hexagonal head (83). Preferably, a sealing gasket (82) is provided between said removable clean-out stopper (80) (FIG. 8) and said clean-out port (53).

Figure 6:
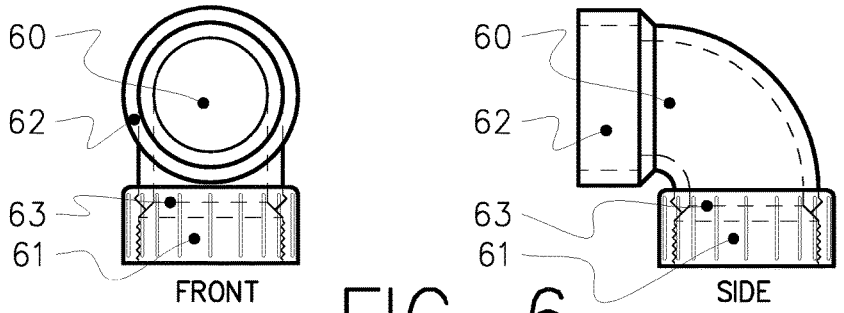
FIG. 6 is a front and side view of the adjustable pipe connector.
Figure 9:
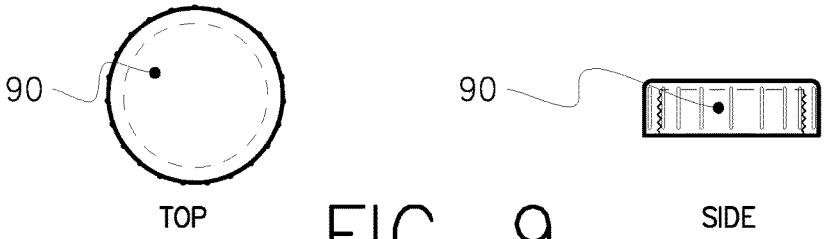
FIG. 9 is a top and side view of the removable test cap

The 'U' shape p-trap pipe (50) terminates at the connection to the inlet opening (51). Said p-trap pipe is connected with and integrally part therein of said inlet opening (51). Said inlet opening (51) is preferably a male configured circumferential flange that is threaded to receive the adjustable pipe connector (60) (FIG. 6). Said inlet opening is initially provided with a preferably female configured circumferential threaded removable test cap (90) (FIG. 9). Said removable test cap (90) (FIG. 9) would be twisted to unlock and be removed after testing has been completed and prior to said adjustable pipe connector (60) (FIG. 6) is installed.

Said adjustable pipe connector (60) (FIG. 6) is generally a formed 90 degree (elbow) section of pipe. At one end of said adjustable pipe connector (60) (FIG. 6) is preferably a female circumferential flange (62) that is sized and shaped to provide a solvent welded connection to the drain line extending from the plumbing fixture (not shown). At the other end is preferably a female configured threaded circumferential flange (61) to mate with said inlet opening (51). Said adjustable pipe connector (60) (FIG. 6) articulates to align with the angle of the drain line extending from the plumbing fixture. When the drain line angle has been aligned, said threaded circumferential flange (61) is preferably twisted to lock with said inlet opening (51) to form a compression seal. Preferably, a compression gasket (63) is provided between said adjustable pipe connector (60) (FIG. 6) and said inlet opening (51).

Figure 7:
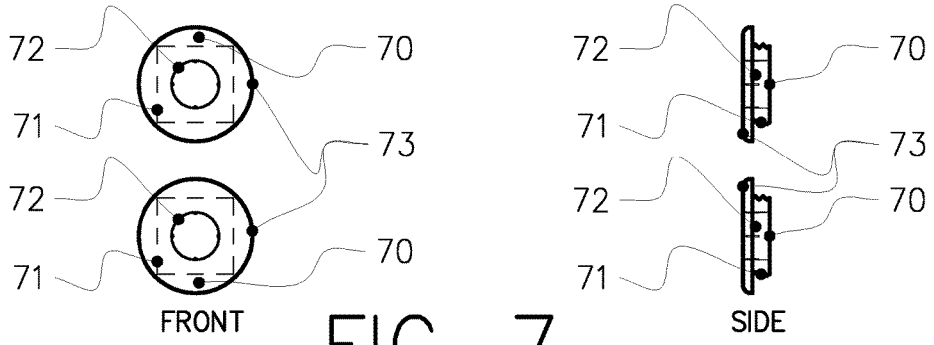
FIG. 7 is a front and side view of the locking escutcheons

The compartment beside said inlet opening (51) contains four supply water openings (54). Two of the supply water openings (54) are front facing and two are back facing to accommodate the reversible function of said housing. Said supply water openings (54) are preferably rectangular in shape to resist any rotation that may be exerted on the supply water assembly. Each said supply water opening (54) is configured to mate with an ancillary locking escutcheon (70) (FIG. 7). The perimeter of the four sides of each said supply water opening (54) is preferably molded with a plurality of ribs (57) to positively engage and fix said locking escutcheon (70) (FIG. 7) in place.

Said locking escutcheon (70) (FIG. 7) is preferably an annular head (73) connected with and integrally part therein of a preferably a male configured rectangular end (71) with a plurality of ribs. Said rectangular end is sized and shaped to mate with each said supply water opening (54). A circular opening (72) extends through said locking escutcheon (70) (FIG. 7). Said circular opening (72) has a plurality of raised fins to resist any rotation that may be exerted by the buildings water supply line when installed. Said annular head (73) is preferably keyed to differentiate between the hot and cold water supply lines. Said locking escutcheon (70) (FIG. 7) is orientated and aligned with the supply water opening (54) and pressed into place positively engaging and fixing said locking escutcheon (70) (FIG. 7) into said reversible housing (FIG. 5) fixing the supply water lines in place. The water supply lines are routed through the top and/or side rectangular access openings (58) to connect to the building supply lines.

The removable front panel (FIG. 10) has flanges that extend beyond the perimeter of said reversible housing and is divided into two pieces, a top front panel (100) and a bottom front panel (101). Said top front panel (100) has one large generally rectangular shaped opening that allows for the drain and supply lines to pass and connect to said reversible housing (Fig. E). The interior face of said top front panel (100) is molded with raised tabs with a plurality of ribs (102) that mate with the perimeter ribs (57) of said reversible housing (FIG. 5) when pressed into place regardless the orientation of said reversible housing (FIG. 5).

Said bottom front panel (101) is generally solid to cover and conceal said internal p-trap piping (50) except for one small circular figure pull hole (103) for removal of said panel. The interior face of said bottom front panel (101) is molded with raised tabs with a plurality of ribs (102) that mate with the perimeter ribs (57) of said reversible housing (FIG. 5) when pressed into place regardless the orientation of said reversible housing (FIG. 5).

A key advantage of the present P-trap plumbing connection and method lies in the advantages provided over current installation methods. This is especially apparent by a comparison of the use and esthetics of the space below a sink. With current installation methods, the piping is exposed to view and is formed of multiple individual pieces assembled by hand. This location, directly below the fixture (sink), offers the least limited area for a plumber to work in. The pipes are typically black or white plastic individually glued together and the joints are typically marred from excess glue runs. The completed pipe assembly penetrates the wall and probably the back of a cabinet to connect to the buildings plumbing lines which run within the wall. Usually there is little attention paid to finishing the wall and/or cabinet around the pipe penetration particularly when that penetration is at an angle which is not perpendicular to the wall. The completed hand assembled p-trap and drain piping can snake through the area beneath a sink or the inside of a cabinet occupying most of the space, limiting accessibility and creating a perceived unsanitary environment. Additionally, the water supply lines which also penetrate the wall and/or cabinet, each at a different location, compound the diminished use and esthetic of that same space.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A P-trap Plumbing Connection comprising:

a housing having a front, a back, and opposed sides that define an interior cavity;

a continuous P-trap pipe positioned within the interior cavity of the housing, the P-trap pipe having an inlet end and an outlet end, the inlet end having an inlet connection at one of the front or the back of the housing and the outlet end having an outlet connection at one of the opposed sides of the housing; and an access opening giving access to the P-trap pipe in the interior cavity being provided in at least one of the front or the back of the housing, and the access opening being closed by a removable closure panel.

2. The P-trap Plumbing Connection of claim 1, wherein the continuous P-trap pipe has an inside diameter of 1½ inches (38 mm).

3. The P-trap Plumbing Connection of claim 1, wherein the continuous P-trap pipe has an inside diameter of 1¼ inches (32 mm).

4. The P-trap Plumbing Connection of claim 1, wherein the continuous P-trap pipe has an inside diameter of the 2 inches (51 mm).

5. The P-trap Plumbing Connection of claim 1, wherein the housing also houses a cold water connection and a hot water connection.

6. The P-trap Plumbing Connection of claim 1, wherein the housing has mounting flanges on one of the opposed sides of the housing opposite to the outlet connection.

* * * * *